US008485273B2

(12) United States Patent
Elsmark et al.

(10) Patent No.: US 8,485,273 B2
(45) Date of Patent: Jul. 16, 2013

(54) METHOD AND DEVICE FOR TIGHTENING JOINTS

(75) Inventors: Karl Johan Lars Elsmark, Saltsjo-Boo (SE); Lars Magnus Persson, Stockholm (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 329 days.

(21) Appl. No.: 12/991,206

(22) PCT Filed: May 8, 2009

(86) PCT No.: PCT/SE2009/000233

§ 371 (c)(1),
(2), (4) Date: Dec. 3, 2010

(87) PCT Pub. No.: WO2009/136840

PCT Pub. Date: Nov. 12, 2009

(65) Prior Publication Data

US 2011/0079406 A1 Apr. 7, 2011

(30) Foreign Application Priority Data

May 8, 2008 (SE) ..... 0801024

(51) Int. Cl.
*B25B 21/00* (2006.01)

(52) U.S. Cl.
USPC ..... 173/1; 173/2; 173/5; 173/6; 173/183; 173/176

(58) Field of Classification Search
USPC ..... 173/1, 2, 5, 6, 176, 183
See application file for complete search history.

(56) References Cited

U.S. PATENT DOCUMENTS

| | | | | |
|---|---|---|---|---|
| 4,027,530 | A * | 6/1977 | Tambini et al. | 73/761 |
| 4,233,721 | A * | 11/1980 | Eshghy | 29/407.02 |
| 4,375,121 | A * | 3/1983 | Sigmund | 29/407.02 |
| 4,540,318 | A * | 9/1985 | Hornung et al. | 408/9 |
| 4,961,035 | A * | 10/1990 | Inaba et al. | 318/600 |
| 5,154,242 | A * | 10/1992 | Soshin et al. | 173/178 |
| 5,215,270 | A * | 6/1993 | Udocon et al. | 29/407.02 |
| 5,526,460 | A | 6/1996 | DeFrancesco et al. | |
| 7,055,620 | B2 | 6/2006 | Nadig et al. | |

(Continued)

FOREIGN PATENT DOCUMENTS

| | | | |
|---|---|---|---|
| EP | 0 680 808 | A1 | 11/1995 |
| WO | WO 02/081153 | A1 | 10/2002 |
| WO | WO 2009/051543 | A1 | 4/2009 |

OTHER PUBLICATIONS

International Search Report dated Aug. 6, 2009 issued in International Appln. No. PCT/SE2009/000233.

*Primary Examiner* — Brian D Nash
(74) *Attorney, Agent, or Firm* — Holtz, Holtz, Goodman & Chick, PC

(57) ABSTRACT

An electric assembly device for tightening of fastener includes a housing and a rotation. motor which is drivingly connected to an output shaft. The output shaft has a forward portion extending out of the housing, and is adapted to carry a coupling device for releasable coupling with a fastener during tightening, which is to be performed along a first rotation axis. The device is adapted to determine an angular displacement of the housing with respect to the first rotation axis during tightening of the fastener, and to control the rotation speed of the motor during tightening based on the determined angular displacement of the housing.

18 Claims, 5 Drawing Sheets

U.S. PATENT DOCUMENTS 7,121,358 B2 * 10/2006 Gass et al. ..... 173/2
2006/0081386 A1 * 4/2006 Zhang et al. ..... 173/2
2007/0084613 A1 4/2007 Zhang et al.
2011/0079406 A1 * 4/2011 Elsmark et al. ..... 173/1

* cited by examiner

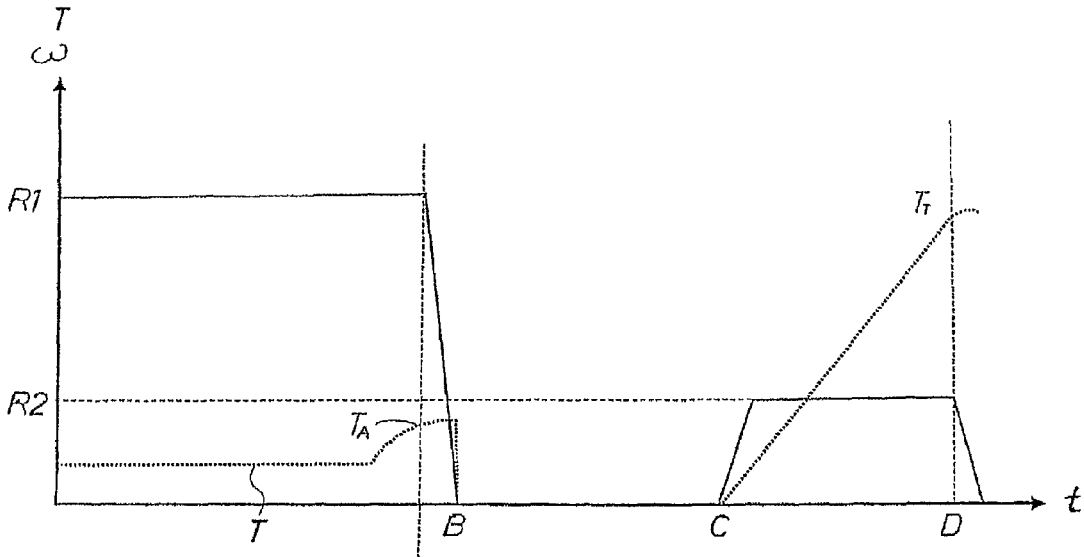
PRIOR ART FIG 1A
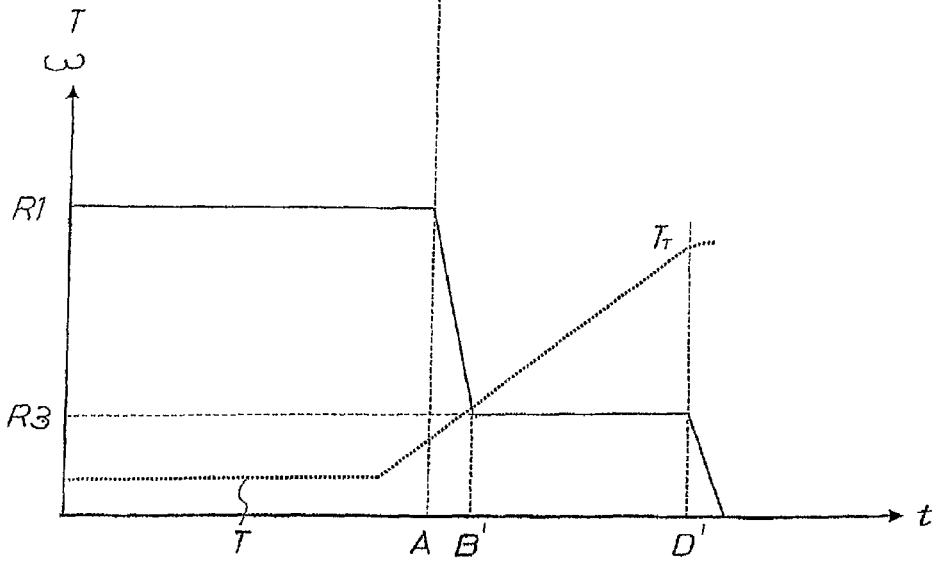
PRIOR ART FIG 1B

METHOD AND DEVICE FOR TIGHTENING JOINTS

This application is a U.S. national phase application under 35 USC 371 of International Application PCT/SE2009/000233 filed May 8, 2009.

FIELD OF THE INVENTION

This invention relates to devices for tightening threaded fasteners to a desired tightening force or clamping force. In particular, the present invention relates to an electric assembly device and a method for tightening of fasteners.

BACKGROUND OF THE INVENTION

The increasing requirement of rapid assembly in assembly plants such as manufacturing plants has resulted in the development of sophisticated assembly tools. For example, with regard to the tightening of joints, a threaded fastener such as a nut, screw or bolt often has to be rotated a number of turns with a relatively low torque prior to the fastener reaching a point where the joint actually starts to tighten and the torque thereby starts to rise.

Consequently, it is highly desirable that the initial threadening or running down phase can be carried out as quickly as possible, since this initial number of turns often is considerably greater than the number of turns (or even part of a turn) that the fastener rotates during the actual tightening phase, and since otherwise a considerable portion of the total assembly time of a particular joint can be consumed during the initial stage of threading.

For this reason, electrically powered assembly tools have been developed where the tightening of a joint is carried out in two steps, namely a first step during which the joint is tightened at a high speed to a predetermined torque level, whereafter the joint is further tightened up to a final predetermined pretension level in a second step at a lower speed.

However, such tools can, in particular with regard to high-torque joints (e.g., in the order of 50 Nm or more), impose undesired jerks of the tool when the torque starts to rise if the operator is unprepared to the sudden torque increase. Such jerks can be very uncomfortable to the operator, and also be a risk of danger if the operator is subject to a powerful jerk of the tool, e.g. when standing close to a wall or sharp objects.

Therefore, control methods have been developed, where the rotation speed of the tightening tool in the second step is controlled in a manner such that it is possible to obtain a tightening process that is not only fast, but which is also more advantageous from an ergonomic point of view.

According to the prior art there basically exists two methods of accomplishing the tightening of threaded joints, both being two-step tightening methods where the first method essentially starts with a high, substantially constant rotational speed until the tightening torque has reached a threshold, whereafter a pause is imposed to prepare the operator for the subsequent torque increase that is about to come. In the second step, the threading is operated at a reduced speed and is kept constant until the tightening torque has reached its target level.

The second method is in fact a one-step method and comprises a first phase that is similar and rather "static" to the above, but wherein in a second phase, instead of first reducing the speed to zero as above, the speed is immediately reduced to an intermediate speed which then keeps the tightening speed constant until the target torque has been reached.

Although the above described methods are capable of providing a substantial improvement for the operator from an ergonomics point of view, and to a great extent reduce the tiring and uncomfortable jerks that normally occur during a tightening process, the tightening process will still remain similar for all operators, with the result that while the above tightening processes can be perceived as comfortable to some operators, the tightening process can be perceived as having too low degree of flexibility for others.

Consequently, there exists a need for an improved electric screw joint tightening tool that is capable of being operated by means of more flexible methods to thereby improve ergonomics and operator satisfaction.

SUMMARY OF THE INVENTION

It is an object of the present invention to provide an electric screw joint tightening device that is capable of being operated in a manner that is favourable from an ergonomics point of view for the operator. It is another object of the present invention to provide an electric screw joint tightening tool that is capable of providing additional functionality during tightening of fasteners. These objects are achieved by a device according to the characterizing portion of the present invention.

According to the invention, it is provided an electric power tool for tightening of fasteners, said device comprising a coupling means for releasable coupling with the said fastener during tightening, e.g. bit-screw or socket-nut arrangement, and a device housing comprising a motor for rotating the said coupling device and thereby fastener during tightening, said tightening being arranged to be performed along an axis, characterised in that said device comprises means for determining an angular rotation of said device with respect to this axis during tightening of the fastener, and means for controlling the rotation of the motor during tightening using the determined angular rotation.

This has the advantage that the assembly device can be made to operate in a manner that is more adapted to the individual operator, since by detecting the angular rotation of said device with respect this axis, the speed of the motor, and thereby the rotational speed of the fastener, can be controlled based on the manner in which the operator moves the tool during fastening, and thereby take into account other parameters than has previously been possible.

Further characteristics of the present invention, and advantages thereof, will be evident from the following detailed description of preferred embodiments and appended drawings, which are given by way of example only, and are not to be construed as limiting in any way.

BRIEF DESCRIPTION OF THE DRAWINGS

FIGS. 1A-B show two methods of tightening fasteners according to the prior art.

DETAILED DESCRIPTION OF EXEMPLARY EMBODIMENTS

In order to clarify the advantages of the present invention, the above mentioned two prior art methods of tightening fasteners will first be briefly described with reference to FIGS. 1A-B.

In FIG. 1A is shown a graph of the variation in time of the tightening torque and the rotational speed of the tightening during a typical tightening process. The solid line represents the rotational speed of the tightening, and the dashed line represents the tightening torque. As can be seen in the figure, the method starts with a high, substantially constant rotational speed R1, which is maintained for as long as the tightening torque is below a first threshold $T_A$, i.e. to point A in the figure. At point A it is consequently detected that the torque has started to rise, and when this is detected, the rotational speed of the tightening is reduced to zero, point B.

Point A is generally a point where the tightening torque quickly has started to rise in a manner that is detectable to the operator of the tool. This point is sometimes referenced to as "snug" point.

When the speed has been reduced to zero, the method waits for a predetermined, ergonomically suitable, period of time, to a point C in time, where the tightening speed is set to a reduced speed R2<R1, which is kept until it has been determined that the tightening torque of the joint has reached its target torque $T_T$, at point D. When the target torque is reached and the joint thereby being determined as tightened, the rotational speed is reduced to zero.

Although the speed in the second step is being shown as substantially constant, it can be arranged to vary so that $$\frac{dT}{dt},$$

instead is kept constant.

In FIG. 1B is shown the second of the above mentioned methods of controlling the tightening process. This method is similar to the method of FIG. 1A up to point A. However, instead of reducing the speed to zero as above, the speed is reduced to an intermediate speed R3 which when reached at point B' is kept constant (or, alternatively, $$\frac{dT}{dt}$$

is kept constant) until the target torque $T_T$ is reached at point D'. Consequently, this method does not allow the operator to "prepare" for the torque increase, although some jerk mitigation is obtained by the reduction of the rotational speed of the tool.

According to the present invention, however, considerably more sophisticated methods of operation are possible by using signals provided from means for determining an angular rotation of the device body with respect to the axis constituting the direction of tightening of the said joint (i.e., the direction in which e.g. a nut moves when being threaded onto e.g. a threaded pin), and means for controlling the rotation of said motor using the said determined angular rotation.

Figure 2A:
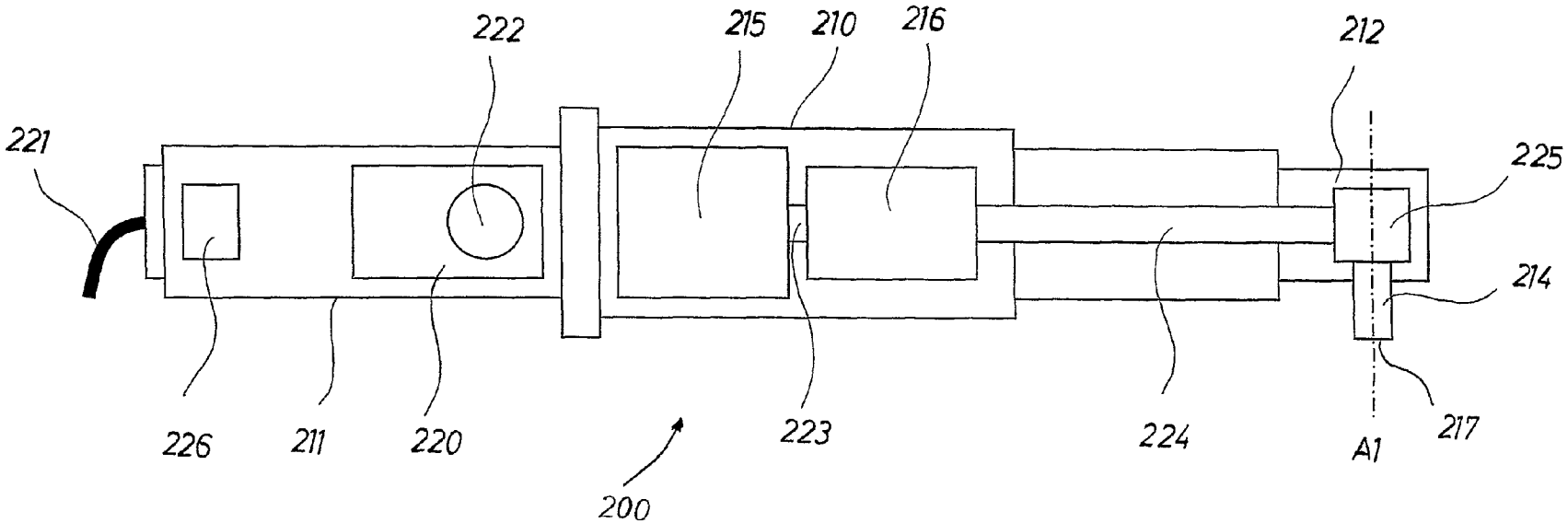
FIG. 2A is schematically shows a device according to an exemplary embodiment of the present invention.

In FIG. 2A is schematically shown a device 200 in the form of an electric assembly tool according to an exemplary embodiment of the present invention. The device 200 has a housing 210, part of which constituting a rear handle 211 for gripping by a device operator when being used. Within the housing 210, there is an electric motor 215 which is power supplied by means of an external power source via a cable 221. In an alternative embodiment, the electric motor 215 is, instead, power supplied by one or more batteries that, e.g., can be located within the rear handle.

The device also comprises a motor output shaft 223, which is connected to a gearing 216 so as to enable a fastener to be driven by the device 200 to be driven at a rotational speed being different from the rotational speed of the variable speed rotation motor 215. Further, a gearing output shaft 224 extends from the gearing 216 to an angle drive 225, which comprises an output shaft 214, having a forward portion 217 extending out of said housing 210, and being adapted to carry a coupling means, (e.g. nut socket, not shown) obtaining a releasable connection with a fastener for tightening a joint. The forward portion 217 of the output shaft 214 can be of any known type used for rotational fastening, e.g. square, polygonal.

The device 200 further comprises an electronic control unit 220, which governs the operation of the device 200 and comprises means for receiving various signals from and/or transmitting signals to, e.g., an external unit to which the tool can be connected, via a suitable cable, and sensors, such as a torque sensor (not shown) for continuously measuring the tightening torque during tightening and a gyroscopic sensor 226, which will be explained more in detail below.

The received signals, possibly together with other information, can then be used in a data processing unit in the control unit 220, which, using the received sensor signals and data, and by means of a computer program, which, e.g., can be stored in a computer program product in form of storage means in, or connected to the processing unit, perform required calculations to control of the motor 215 in a desired manner and thereby the tightening process. Consequently, the control unit 220 comprises means for controlling the power supply to the said motor to control its operation, and thereby rotational speed and torque of the tightening of the joint, either directly or by generates control signals for transmission to a separate motor control unit.

The device 200 is also in a preferred embodiment provided with a light emitting diode or other visual indication means 222 so as to inform the operator of the status of the current joint. For example, the diode can be used to indicate that the joint is tightened. As an alternative, a plurality of diodes can be used to indicate various stages of the tightening process, and/or a loudspeaker device can be used to indicate progressing/finished tightening by sound.

With regard to the gyroscopic sensor 226, it can, e.g., be in the form of an electrical or optical gyroscope, although other kinds of gyroscopic sensors are also contemplated. Such sensors are known in torque wrenches, see e.g. EP 1 022 097 A2 (BLM S.a.s. di L. Bareggi & C.), but for a completely different reasons, e.g. to determine the number of turns that a fastener has been rotated and speed of operation of the wrench.

The said document also includes a brief description of such gyroscopic sensors, which basically outputs an electrical signal that is proportional to the rotation the gyroscope is subjected to.

Figure 2B:
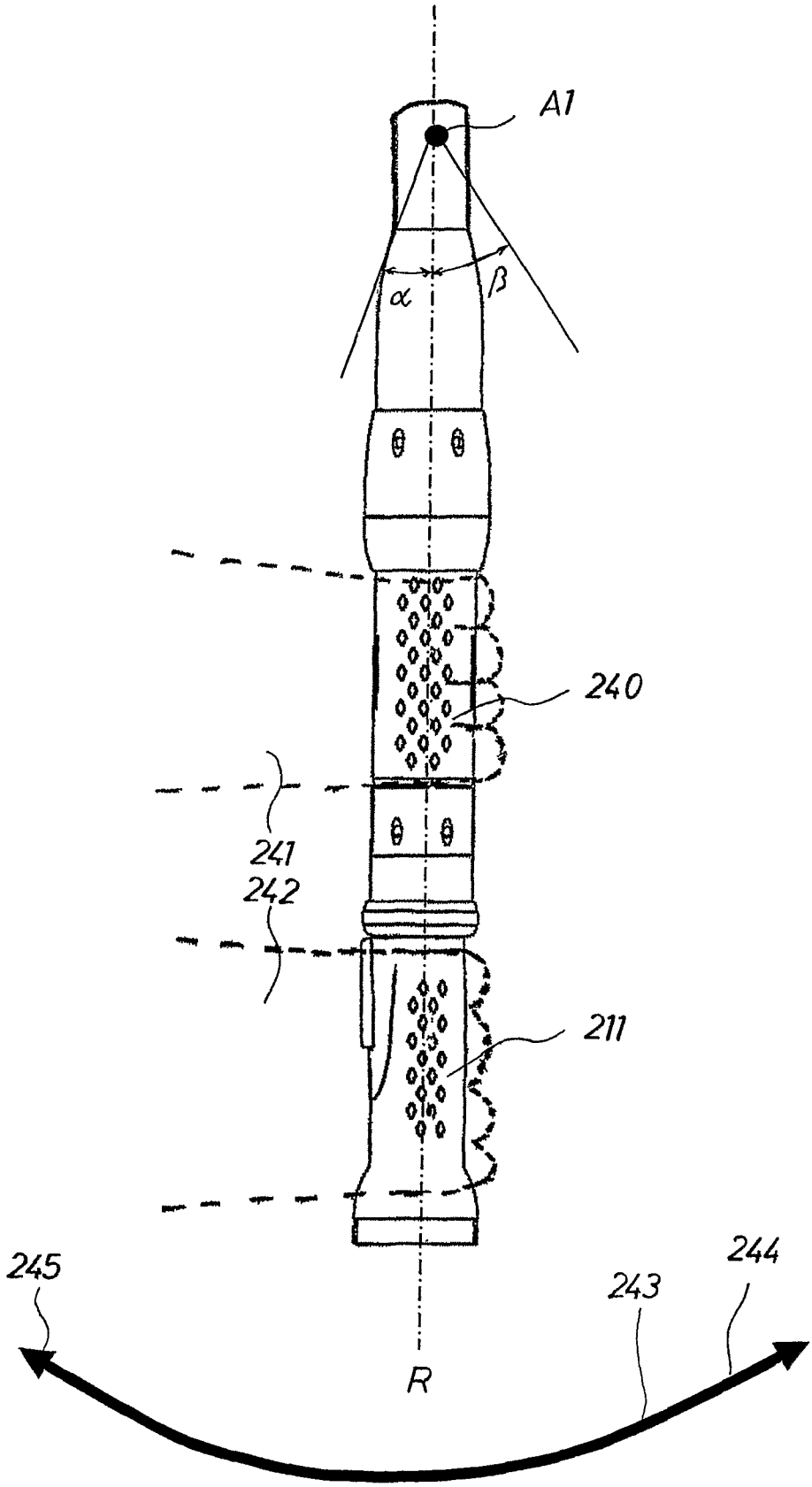
FIG. 2B shows the device of FIG. 2A seen from above.

According to the present invention, the signals output from the gyroscopic sensor 226 are, as was mentioned above, used to control the motor 215. This will be exemplified with reference to FIG. 2B, which shows the device 200 of FIG. 2A from above. As can be seen in figure, the device 200 comprises, apart from rear handle 211 also an intermediate handle 240 so as to allow the operator to operate the device using both hands, which can be required in high torque tightenings (for example, in the car industry, a maximum torque of 70-100 Nm is used in assembly using devices such as the one disclosed). The hands 241, 242 of the operator are indicated by dashed lines.

In the figure, the axis along which the tightening is being performed, also defined as the rotation axis, (perpendicular to the paper, the fastening being carried out inwards) is indicated by Al. The starting position at which tightening started is, with regard to the angular position about the axis A1 often arbitrary, i.e., the operator can, if possible with respect to surrounding obstacles, position the device 200 in any arbitrary angle about the axis Al prior to starting the tightening. In one embodiment, the position at which the fastening is started is set as a reference position, that is, the sensor signals output by the gyroscopic sensor 226 when the tightening is started is determined as reference.

This reference position is indicated in figure by dashed line R. Using the signals from the gyroscopic sensor it will now be possible for the control system of the device to detect angular rotation/angular displacement of the device about the axis Al, i.e. movements of the device along the disclosed arc 243, giving rise to angular deviations/displacement $\alpha$ and $\beta$. This has the advantage that the control system is capable of detecting e.g., jerks, that the operator is subjected to, e.g. when the torque is rising. Thereby, using information from the gyroscopic sensor, the control system can, as soon as it is detecting the start of a jerk that is probable of being perceived as uncomfortable to the operator, reduce the speed of the motor so as to reduce the force that the operator is subject to and .thereby reduce the amplitude (i.e. angular movement and rotational speed the said device 200 is moving with in either of the directions indicated by arrows 244, 245) of the jerk that the operator is subjected to. Consequently, the present invention has the advantage that as soon as it is detected that a jerk is about to happen, e.g. if the device has deviated from the reference R by a certain angle a or 0 within a certain period of time, the rotational speed of the motor can be immediately reduced or the motor even being stopped so that the operator is given time to respond to the jerk increase (e.g. by muscle tensioning).

The use of the gyroscopic sensor (or any kind of suitable accelerometer that is capable of providing signals from which at least one of acceleration, speed, or angle along the arch 243 can be determined) has the advantage that a number of tightening methods providing additional value to the operator can be realised.

For example, using the present invention, the device 200 can be used as a throttle grip, that is, instead of having a device wherein, as disclosed above, $$\frac{dT}{dt}$$

or the rotational speed of the tightening is kept constant, the operator can be allowed to control the speed of the tightening (at least for as long as the speed set by the operator does not violate any higher control strategy for ensuring a securely tightened joint). This can for example, be accomplished by a control strategy being of the kind that if the operator keeps the device in, or substantially in, the reference position R shown in FIG. 2*b* the tightening speed $$\left(\text{or } \frac{dT}{dt}\right)$$

can be kept constant as in the prior art, while if the operator pulls the device towards himself/herself, i.e. moves the device to the left in the figure, the rotational speed of the fastener can be arranged to increase in dependence of the deviation from the reference position R according to any suitable relationship. Conversely, if the operator moves the device in the opposite direction, i.e. to the right in the figure, the speed can be arranged to be reduced.

Consequently, the present invention allows for the operator to operate the device in a manner in which the operator freely can set the tightening speed and thereby $$\frac{dT}{dt}$$

according to personal preferences.

In another example, the tightening speed of the device is controlled in a manner that strives to keep the device in the reference position R. That is, if the device moves to the right in the figure, which indicates that the $$\frac{dT}{dt}$$

is a bit high for the current operator, the speed is reduced so that the $$\frac{dT}{dt}$$

decreases whereby it will be easier for the operator to return the device to the reference position. Conversely, if the operator moves the device towards himself/herself it can be assumed that the current $$\frac{dT}{dt}$$

is a bit low and that the rotational speed therefore can be increased.

In a further example, the device is operated in a manner that replicates the working function of a click wrench. In this embodiment, the torque will increase when the operator moves the device towards himself/herself while when moving the device away, i.e., the operator repositioning the tool for continued tightening in a manner similar to the conventional click wrench no tightening will occur but it will only be ensured that the joint is not loosened.

It is to be understood that although the above described methods of tightening a joint has been disclosed with particular directions of movements of the device, the directions can be the opposite instead. That is, for example, the rotational speed of the device can be arranged to increase when the operator pushes the device away should it be so preferred.

Figure 3A:
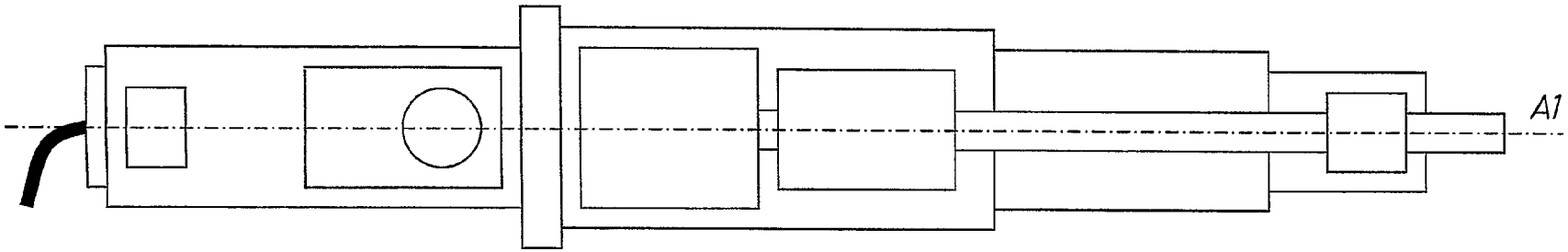
FIGS. 3A-B discloses another exemplary device with which the present invention can advantageously be utilized.
Figure 3B:
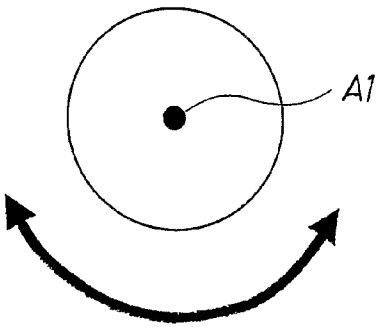
Figure 4A:
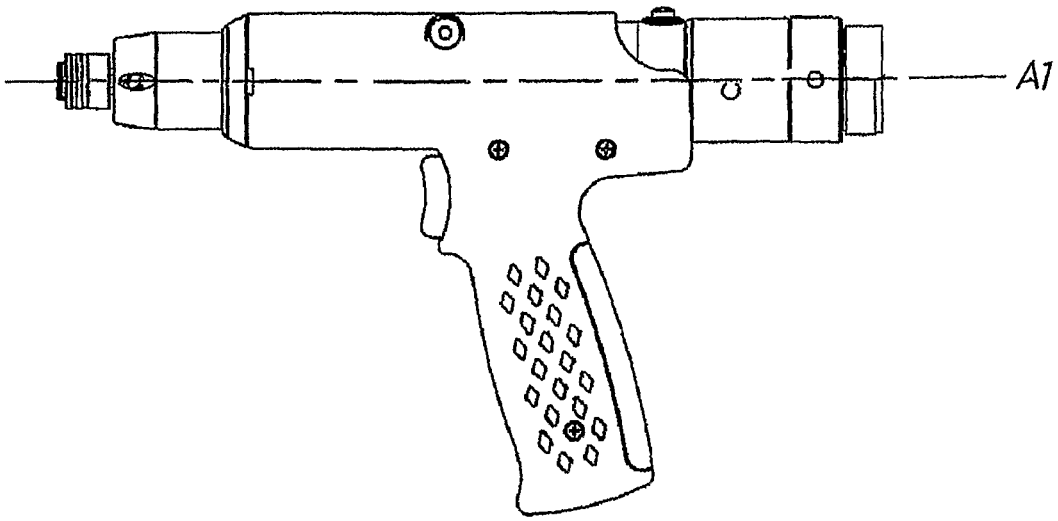
FIGS. 4A-B discloses a further exemplary device with which the present invention can advantageously be utilized.
Figure 4B:
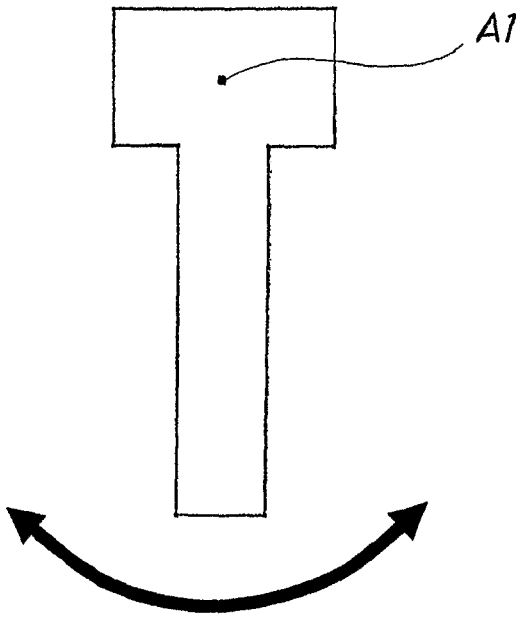

Further, although the present invention has been described in connection with a device for high-torque tightening above, the present invention is applicable in other kinds of joint tightening devices as well. For example, the device need not be an angled device that can be straight (see, for example, FIGS. 3A-B, in which case it is the rotation of the device that is controlled (see the arrows in FIG. 3B) or being used to control the rotational speed of the device according the above), or a device of a pistol type (see FIGS. 4A-B), in which case it is the rotation of the handle with respect to the axis A1 of the tightening that is controlled (see the arrows in FIG. 4B, which shows the device of FIG. 4A from behind) or being used to control the rotational speed of the device according the above.

Although the present invention has been exemplified using a gyroscopic sensor, it is to be understood that any suitable means for such means for detecting an angular rotation of the device with respect to the axis of tightening of the said joint, or from which the said angular rotation can be determined, has been contemplated and is to be included in the scope of the present invention.

The invention claimed is:

1. An electric assembly device for tightening threaded fasteners, comprising:

a housing;

a variable speed rotation motor;

an output shaft connected to the motor and rotatable about a rotation axis;

coupling means provided on the output shaft for coupling the output shaft to a threaded fastener to be tightened;

wherein the housing is arranged to be manually supported by an operator and is angularly displaceable relative to the rotation axis;

determining means for determining an angular displacement of the housing relative to the rotation axis during tightening of the threaded fastener; and a control unit which controls a rotation speed of the motor during tightening in relation to the determined angular displacement of the housing;

wherein the rotation speed of the motor is arbitrarily determinable by the operator by angularly displacing the housing relative to the rotation axis in one of a rotation direction of the output shaft and a direction opposite to the rotation direction of the output shaft, to thereby correspondingly determine a tightening speed of the fastener; and wherein the control unit is configured to:

(i) increase the rotation speed of the motor to thereby increase the tightening speed of the fastener if a displacement of the housing about the rotation axis in one of the rotation direction of the output shaft and the direction opposite to the rotation direction of the output shaft is detected, and (ii) decrease the rotation speed of the motor to thereby decrease the tightening speed of the fastener if a displacement of the housing in the other of the rotation direction of the output shaft and the direction opposite to the rotation direction of the output shaft is detected.

2. The device according to claim 1, wherein the determining means further comprises means for establishing a reference position of said housing; and wherein the control unit is further configured to:

(i) increase the rotation speed of the motor to thereby increase the tightening speed of the fastener if a displacement of the housing about the rotation axis in one of the rotation direction of the output shaft and the direction opposite to the rotation direction of the output shaft from said reference position is detected, and (ii) decrease the rotation speed of the motor to thereby decrease the tightening speed of the fastener if a displacement of the housing about the rotation axis in the other of the rotation direction of the output shaft and the direction opposite to the rotation of the output shaft from said reference point is detected.

3. The device according to claim 2, wherein said increasing/decreasing of the rotation speed of the motor, and the corresponding increasing/decreasing of the tightening speed of the fastener, is arranged to be dependent on an amount of the angular displacement of the housing from said reference position.

4. The device according to claim 3, wherein said one of the rotation direction of the output shaft and the direction opposite to the rotation direction of the output shaft in which the housing is angularly displaced is a direction towards the operator of the device.

5. The device according to claim 2, wherein said one of the rotation direction of the output shaft and the direction opposite to the rotation direction of the output shaft in which the housing is angularly displaced is a direction towards the operator of the device.

6. The device according to claim 2, wherein said housing has an elongated shape.

7. The device according to claim 2, wherein said housing is arranged at angle with respect to the rotation axis.

8. The device according to claim 2, wherein said determining means comprises a gyroscopic sensor.

9. The device according to claim 1, wherein said one of the rotation direction of the output shaft and the direction opposite to the rotation direction of the output shaft in which the housing is angularly displaced is a direction towards the operator of the device.

10. The device according to claim 1, wherein said housing has an elongated shape.

11. The device according to claim 1, wherein said housing is arranged at angle with respect to the rotation axis.

12. The device according to claim 1, wherein said determining means comprises a gyroscopic sensor.

13. An electric assembly device for tightening threaded fasteners, comprising:

a housing;

a variable speed rotation motor;

an output shaft connected to the motor and rotatable about a rotation axis;

coupling means provided on the output shaft for coupling the output shaft to a threaded fastener to be tightened;

wherein the housing is arranged to be manually supported by an operator and is angularly displaceable relative to the rotation axis;

determining means for determining an angular displacement of the housing relative to the rotation axis during tightening of the threaded fastener; and a control unit which controls a rotation speed of the motor during tightening in relation to the determined angular displacement of the housing;

wherein the rotation speed of the motor is arbitrarily determinable by the operator by angularly displacing the housing relative to the rotation axis in one of a rotation direction of the output shaft and a direction opposite to the rotation direction of the output shaft, to thereby correspondingly determine a tightening speed of the fastener; and wherein the control unit is configured to:

(i) drive the motor to rotate the output shaft such that the fastener is rotated in a tightening direction if a displacement of the housing about the rotation axis in one of the rotation direction of the output shaft and the direction opposite to the rotation direction of the output shaft is detected, and (ii) drive the motor to rotate the output shaft such that the fastener is rotated at a relatively slower speed or is kept substantially still if a displacement of the housing in the other of the rotation direction of the output shaft and the direction opposite to the rotation direction of the output shaft is detected.

14. The device according to claim 13, wherein said one of the rotation direction of the output shaft and the direction opposite to the rotation direction of the output shaft in which the housing is angularly displaced is a direction towards the operator of the device.

15. The device according to claim 13, wherein said housing has an elongated shape.

16. The device according to claim 13, wherein said housing is arranged at angle with respect to the rotation axis.

17. The device according to claim 13, wherein said determining means comprises a gyroscopic sensor.

18. A method for tightening fasteners using an electric assembly device which includes a housing, a variable speed rotation motor, an output shaft coupled to the motor and rotatable about a rotation axis, and coupling means provided on the output shaft for coupling the output shaft to a threaded fastener to be tightened, the housing being arranged to be manually supported by an operator and being angularly displaceable relative to the rotation axis, wherein the method comprises:

determining an angular displacement of the housing relative to the rotation axis during tightening of the threaded fastener; and controlling a rotation speed of the motor during tightening in relation to the determined angular displacement of the housing, wherein the rotation speed of the motor is arbitrarily determinable by the operator by angularly displacing the housing relative to the rotation axis in one of a rotation direction of the output shaft and a direction opposite to the rotation direction of the output shaft, to thereby correspondingly determine a tightening speed of the fastener, and wherein controlling the rotation speed of the motor comprises:

(i) increasing the rotation speed of the motor to thereby increase the tightening speed of the fastener if a displacement of the housing about the rotation axis in one of the rotation direction of the output shaft and the direction opposite to the rotation direction of the output shaft is detected, and (ii) decreasing the rotation speed of the motor to thereby decrease the tightening speed of the fastener if a displacement of the housing in the other of the rotation direction of the output shaft and the direction opposite to the rotation direction of the output shaft is detected.

* * * * *